US011015614B2

(12) United States Patent
Conner et al.

(10) Patent No.: US 11,015,614 B2
(45) Date of Patent: May 25, 2021

(54) VARIABLE VANE DEVICES CONTAINING ROTATIONALLY-DRIVEN TRANSLATING VANE STRUCTURES AND METHODS FOR THE PRODUCTION THEREOF

(71) Applicant: HONEYWELL INTERNATIONAL INC., Morris Plains, NJ (US)

(72) Inventors: Richard David Conner, Peoria, AZ (US); Bruce David Reynolds, Chandler, AZ (US); Timothy Gentry, Tempe, AZ (US); Peter Hall, Phoenix, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 16/656,211

(22) Filed: Oct. 17, 2019

(65) Prior Publication Data

US 2020/0049163 A1 Feb. 13, 2020

Related U.S. Application Data

(63) Continuation of application No. 15/420,717, filed on Jan. 31, 2017, now Pat. No. 10,495,108.

(51) Int. Cl.
*F04D 29/56* (2006.01)
*F01D 17/16* (2006.01)
(Continued)

(52) U.S. Cl.
CPC ..... *F04D 29/563* (2013.01); *F01D 9/041* (2013.01); *F01D 17/162* (2013.01);
(Continued)

(58) Field of Classification Search
CPC .... F04D 29/563; F04D 27/002; F04D 29/023; F04D 29/542; F04D 29/644;
(Continued)

(56) References Cited

U.S. PATENT DOCUMENTS 4,278,398 A 7/1981 Hull
6,887,035 B2 5/2005 Bruce
(Continued)

FOREIGN PATENT DOCUMENTS

EP 2116694 A2 11/2009
EP 2573363 A2 3/2013

OTHER PUBLICATIONS

Extended EP Search Report for Application No. 18154007.1 dated Jun. 19, 2018.

*Primary Examiner* — Joseph J Dallo
(74) *Attorney, Agent, or Firm* — Lorenz & Kopf, LLP

(57) ABSTRACT

Variable vane devices containing rotationally-driven translating vane structures are provided, as are methods for fabricating variable vane devices. In one embodiment, the variable vane device includes a flow assembly having a centerline, an annular flow passage extending through the flow assembly, cam mechanisms, and rotationally-driven translating vane structures coupled to the flow assembly and rotatable relative thereto. The translating vane structures include vane bodies positioned within the annular flow passage and angularly spaced about the centerline. During operation of the variable vane device, the cam mechanisms adjust translational positions of the vane bodies within the annular flow passage in conjunction with rotation of the translating vane structures relative to the flow assembly. By virtue of the translational movement of the translating vane structures, a reduction in the clearances between the vane bodies and neighboring flow assembly surfaces can be realized to reduce end gap leakage and boost device performance.

10 Claims, 7 Drawing Sheets

(51) Int. Cl.

| | |
|---|---|
| ***F01D 9/04*** | (2006.01) |
| ***F04D 27/00*** | (2006.01) |
| ***F04D 29/02*** | (2006.01) |
| ***F04D 29/54*** | (2006.01) |
| ***F04D 29/64*** | (2006.01) |
| *F01D 11/00* | (2006.01) |

(52) U.S. Cl.
CPC ..... *F04D 27/002* (2013.01); *F04D 29/023* (2013.01); *F04D 29/542* (2013.01); *F04D 29/644* (2013.01); *F01D 11/005* (2013.01); *F05D 2220/32* (2013.01); *F05D 2240/12* (2013.01); *F05D 2240/122* (2013.01)

(58) Field of Classification Search
CPC ..... F01D 17/162; F01D 9/041; F01D 11/005; F05D 2240/122; F05D 2220/32; F05D 2240/12
See application file for complete search history.

(56) References Cited

U.S. PATENT DOCUMENTS

| | | | | |
|---|---|---|---|---|
| 7,922,445 | B1 | 4/2011 | Pankey et al. | |
| 9,333,603 | B1 * | 5/2016 | Christophel | F01D 17/16 |
| 2015/0016946 | A1 | 1/2015 | Ottow | |
| 2016/0024959 | A1 * | 1/2016 | Do | F04D 29/563 415/1 |
| 2016/0108821 | A1 * | 4/2016 | Robertson, Jr. | F01D 25/246 60/805 |
| 2016/0251980 | A1 * | 9/2016 | Slavens | F01D 5/12 60/806 |
| 2017/0254266 | A1 * | 9/2017 | Milani | F01D 9/02 |
| 2017/0268357 | A1 * | 9/2017 | Torres | F01D 9/042 |
| 2018/0163543 | A1 * | 6/2018 | Morton | F04C 28/06 |

* cited by examiner

VARIABLE VANE DEVICES CONTAINING ROTATIONALLY-DRIVEN TRANSLATING VANE STRUCTURES AND METHODS FOR THE PRODUCTION THEREOF

CROSS-REFERENCE TO RELATED APPLICATION

This application is a continuation of Application Ser. No. 15/420,717, filed Jan. 31, 2017, now U.S. Pat. No. 10,495,108.

TECHNICAL FIELD

The present invention relates generally to gas turbine engines and, more particularly, to variable vane devices and methods for producing variable vane devices containing rotationally-driven translating vane structures.

BACKGROUND

By common design, a variable vane device contains a plurality of rotatable vanes, which are arranged in an annular array. An outer shroud member circumscribes the annular array of rotatable vanes, which, in turn, circumscribes an inner hub member. Collectively, the outer shroud member and the inner hub member define a static flow assembly through which an annular flow passage extends. The rotatable vanes are positioned within this annular flow passage and can be turned about individual rotation axes to adjust the flow rate through the flow passage. Variable vane devices of this type are commonly integrated into Gas Turbine Engines (GTEs). For example, a GTE platform may be equipped with an Inlet Guide Vane (IGV) system, which contains a variable vane device positioned immediately upstream of the GTE's compressor section. Additionally or alternatively, one or more variable vane devices may be integrated into the compressor section and/or turbine section of a given GTE platform. During engine operation, an actuator rotates the vanes through an angular Range of Motion (ROM) in accordance with commands received from a controller, such as a Full Authority Digital Engine Controller (FADEC). The FADEC may command the actuator to periodically or continually adjust vane angular position in accordance with a predetermined schedule, as a function of core engine speeds, or as a function of another operational parameter of the GTE.

While capable of boosting various measures of engine performance, conventional variable vane devices remain limited in certain respects. As a primary limitation, variable vane devices are prone to leakage at the interfaces between the rotatable vanes and the surrounding static flow assembly (referred to herein as "end gap leakage"). End gap leakage is due, at least in part, to the provision of radial gaps or endwall clearances between edges of the rotatable vanes, the inner circumferential surface or endwall of the outer shroud member, and the outer circumferential surface or endwall of the inner hub member. Variable vane devices are typically designed to minimize such endwall clearances to the extent possible, while ensuring that rubbing, binding, or other physically-restrictive contact does not occur between the vane edges, the shroud endwall, and the hub endwall. However, due to the relatively complex geometric relationship between the vane edges and the annular endwalls, the endwall clearances vary dynamically in conjunction with vane rotation with a corresponding leakage penalty. Such leakage may lower GTE efficiency and result in end gap leakage flow (e.g., vortices and wakes) creating excitation forces, which can result in increased strains on rotors and other components downstream of the variable vane device.

BRIEF SUMMARY

Variable vane devices containing rotationally-driven translating vane structures are provided. In one embodiment, the variable vane device includes a flow assembly having a centerline, an annular flow passage extending through the flow assembly, cam mechanisms, and rotationally-driven translating vane structures coupled to the flow assembly and rotatable relative thereto. The translating vane structures include vane bodies, which are positioned within the annular flow passage and angularly spaced about the centerline. During operation of the variable vane device, the cam mechanisms adjust translational positions of the vane bodies within the annular flow passage in conjunction with rotation of the translating vane structures relative to the flow assembly; e.g., the cam mechanisms may impart each of the vane bodies with a unique radial position corresponding to each unique rotational position of the corresponding translating vane structure. By virtue of the translational movement of the translating vane structures, a reduction in the clearances between the vane bodies and neighboring flow assembly surfaces can be realized to reduce end gap leakage and boost device performance levels. Although not restricted to any particular usage or application, embodiments of the variable vane devices may be advantageously utilized within Gas Turbine Engine (GTE) platforms to boost engine performance and/or to reduce downstream rotor excitation.

In another embodiment, the variable vane device includes a flow assembly through which a flow passage extends. A non-rotating ramped surface is coupled to the flow assembly in a rotationally-fixed relationship. A rotationally-driven translating vane structure is coupled to the flow assembly and rotatable relative thereto through an angular Range of Motion (ROM). The rotationally-driven translating vane structure includes a vane body positioned within the flow passage. A rotating ramped surface is further fixedly coupled to the rotationally-driven translating vane structure and rotates therewith. The rotating ramped surface slides along the non-rotating ramped surface as the rotationally-driven translating vane structure rotates through the angular ROM to adjust the translational position of the vane body within the flow passage. In some implementations, the variable vane device may also include a resilient preload member, such as a spring or wave washer, which exerts a translational force on the rotationally-driven translating vane structure urging contact between the non-rotating and rotating ramped surfaces.

Embodiments of a method for producing a variable vane device, which includes rotationally-driven translating vane structures, are further provided. The variable vane devices may be produced pursuant to original manufacture or, instead, produced by modifying a pre-existing variable vane device initially lacking rotationally-driven translating vane structures. In an embodiment, the method includes the step or process of providing a non-rotating ramped surface coupled to a flow assembly in a rotationally-fixed relationship, as well as further providing a rotating ramped surface fixedly coupled to a rotationally-driven translating vane structure including a vane body positioned in a flow passage of the flow assembly. The non-rotating and rotating ramped surfaces are placed in contact such that the rotating ramped surface slides along the non-rotating ramped surface as the rotationally-driven translating vane structure rotates relative to the flow assembly to adjust a translational position of the vane body within the flow passage.

BRIEF DESCRIPTION OF THE DRAWINGS

At least one example of the present invention will hereinafter be described in conjunction with the following figures, wherein like numerals denote like elements, and.

DETAILED DESCRIPTION

Figure 1:
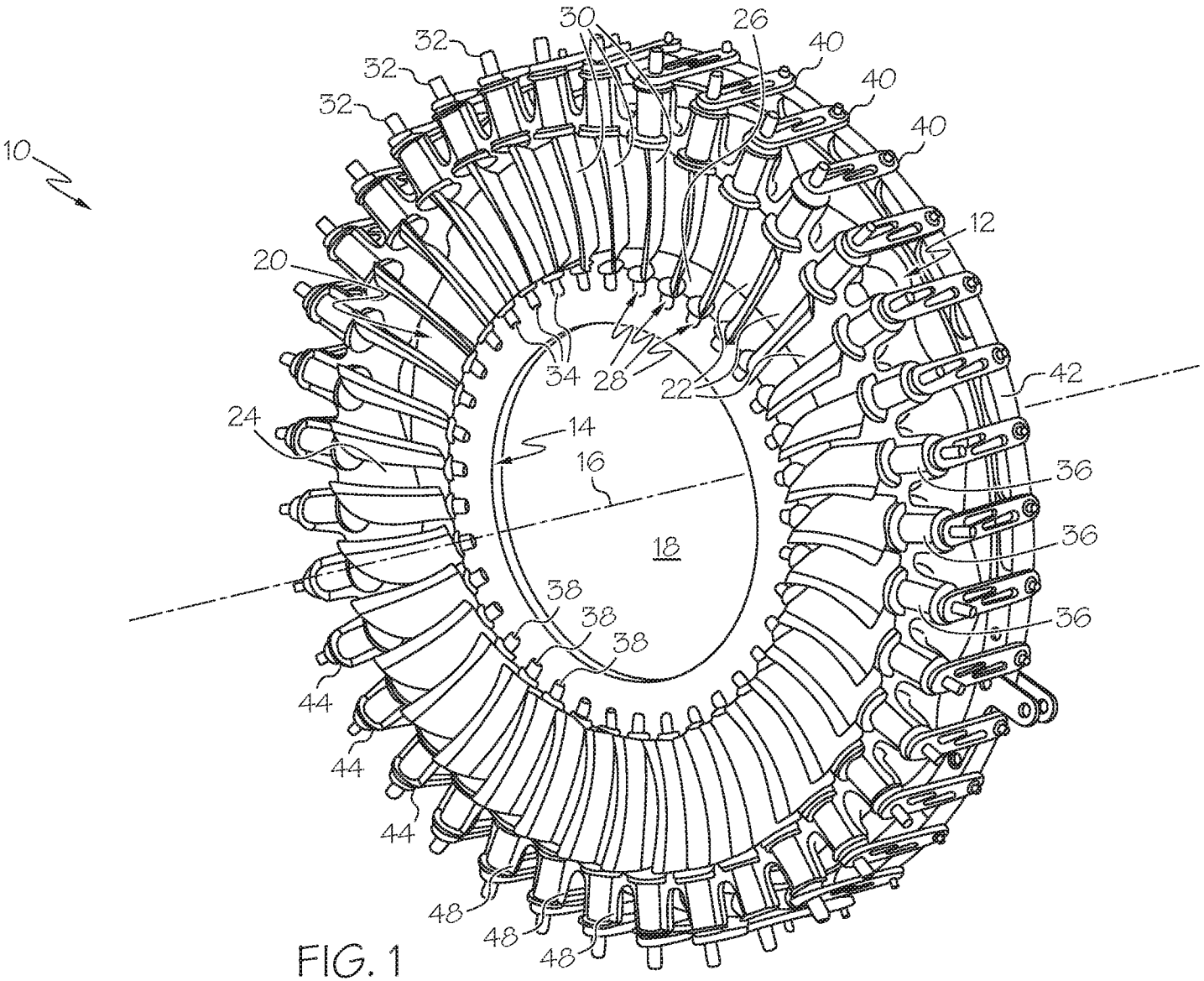
FIG. 1 is an isometric view of a variable vane device containing an annular array of rotationally-driven translating vane structures, as illustrated in accordance with an exemplary embodiment of the present disclosure.

The following Detailed Description is merely exemplary in nature and is not intended to limit the invention or the application and uses of the invention. Furthermore, there is no intention to be bound by any theory presented in the preceding Background or the following Detailed Description. The term "exemplary," as appearing throughout this document, is synonymous with the term "example" and is utilized repeatedly below to emphasize that the description appearing in the following section merely provides multiple non-limiting examples of the invention and should not be construed to restrict the scope of the invention, as set-out in the Claims, in any respect. Furthermore, terms such as "comprise," "include," "have," and variations thereof are utilized herein to denote non-exclusive inclusions. Such terms may thus be utilized in describing processes, articles, apparatuses, and the like that include one or more named steps or elements, but may further include additional unnamed steps or elements. Finally, the term "bore," as appearing herein, refers to a cavity having a generally cylindrical geometry and regardless of the particular manner in which the bore is formed.

The following sets-forth multiple exemplary embodiments of a variable vane device containing rotationally-driven translating vane structures. The translating vane structures are "rotationally-driven" in the sense that, as each vane structure is turned about its respective rotational axis, the rotating vane structure slides linearly or translates along its rotational axis. Such translational movement is imparted to the translating vane structures by cam mechanisms, which are further contained within the variable vane device. The cam mechanisms can assume various different forms for imparting translational movement to the vane structures in conjunction with rotation thereof. In an embodiment, the cam mechanism each include at least one pair of ramped surfaces between which relative rotation occurs when the translating vane structures rotate, as well as at least one resilient preload member urging contact between the ramped surfaces. The ramped surfaces can be machined or otherwise integrally formed in selected surfaces of a static flow assembly and the translating vane structures, formed on discrete pieces (e.g., annular spacers or ramped washers) rotationally affixed to the static flow assembly and to the translating vane structures, or a combination thereof. As the translating vane structures rotate, sliding movement between the ramped surfaces varies the axial heights of the cam mechanisms and, therefore, the translational positions of the vane bodies within the flow passage. By dimensioning the ramped surfaces appropriately, the translational positions of the vane bodies may vary dynamically in conjunction with vane rotation in a manner minimizing the radial gaps or endwall clearances, as taken over the angular Range of Motion (ROM) of the vane structures. End gap leakage across the interfaces between the vane bodies and the annular endwalls may be reduced as a result, with a corresponding improvement in device efficiency.

Embodiments of the variable vane device are advantageously utilized within Gas Turbine Engine (GTE) platforms and are consequently primarily described below in this exemplary context. In this regard, embodiments of the variable vane device are well-suited for usage within Inlet Guide Vane (IGV) systems of the type commonly included within GTE platforms, within variable compressor stages of a GTE, and/or within variable turbine stages of a GTE. Any practical number of variable vane devices can be incorporated into a given GTE, with larger GTE platforms often containing multiple variable vane devices distributed across different stages of the intake, compressor, and/or turbine sections. This notwithstanding, it is emphasized that embodiments of the variable vane device are not restricted to usage in conjunction with GTEs, but rather can be utilized within any fluid-conducting system or platform, including turbochargers, into which one or more low leakage variable vane devices are usefully integrated.

FIG. 1 is an isometric view of a variable vane device 10, which may be included with an IGV system deployed onboard a GTE and which is illustrated in accordance with an exemplary embodiment of the present disclosure. Certain components of variable vane device 10 are not shown in FIG. 1, but are shown in subsequent figures and described below. Variable vane device 10 includes a static flow assembly 12, 14, which has a generally annular or tubular geometry and which is substantially axisymmetric about a centerline 16. Flow assembly 12, 14 is produced from two principal components or annular structures, namely, an outer shroud member 12 and an inner hub member 14. Outer shroud member 12 circumscribes inner hub member 14, which is substantially coaxial with shroud member 12. A central opening 18 is provided through inner hub member 14. Central opening 18 may accommodate the passage of certain components, such as one or more shafts, when variable vane device 10 is installed within a particular GTE. Members 12, 14 can each be assembled from any number of mating pieces or, instead, fabricated as a single piece or monolithic part, such as a single shot casting. In other embodiments, members 12, 14 are each assembled from multiple arc-shaped pieces, which are bolted or otherwise joined together. In still further embodiments, other manufacturing approaches may be utilized.

A flow passage 20 is provided through flow assembly 12, 14 and may extend substantially parallel to centerline 16. In the embodiment shown in FIG. 1, flow passage 20 has a ring-shaped or tubular geometry and is substantially coaxial with centerline 16. For this reason, flow passage 20 is referred to hereafter as "annular flow passage 20." In further embodiments, flow passage 20 may have other geometries; e.g., in certain instances, flow passage may only partially curve or bend around centerline 16. Annular flow passage 20 is located between and radially separates outer shroud member 12 and inner hub member 14; the term "radially," as appearing herein, referring to an axis or direction perpendicular to centerline 16. Outer shroud member 12 has an inner circumferential surface or annular shroud endwall 24, which defines or bounds an outer periphery of annular flow passage 20. Conversely, inner hub member 14 has an outer circumferential surface or annular hub endwall 26, which bounds an inner periphery of annular flow passage 20.

Variable vane device 10 further contains a plurality of rotationally-driven translating vane structures 28. Only a few of translating vane structures 28 (and many of the other repeating components and features of variable vane device 10) are labeled in FIG. 1 to avoid cluttering the drawing. Rotationally-driven translating vane structures 28 each include a vane body 30, an outboard shaft or stem portion 32, and inboard shaft or stem portion 34. Stem portions 32, 34 extend axially from opposing ends of vane body 30, which is typically (but not necessarily) produced to have an airfoil-shaped geometry. Vane bodies 30 are positioned within annular flow passage 20 and are angularly spaced about centerline 16 at regular intervals. Vane bodies 30 thus divide annular airflow passage 20 into a number of flow passage sections 22, which each have a substantially wedge-shaped geometry as viewed along centerline 16. The particular shape and construction of rotationally-driven translating vane structures 28 will vary amongst embodiments. In one embodiment, vane structures 28 are each cast or otherwise fabricated as single piece from an alloy, such as a superalloy. In other embodiments, vane structures 28 may be produced from multiple pieces and various other metallic and non-metallic (e.g., composite) materials.

Inboard stem portions 34 are matingly received in a number of bores 38, which are formed in inner hub member 14, which are angularly spaced about centerline 16, and which penetrate hub endwall 26. Similarly, outboard stem portions 32 are received through a like number of bores 36, which are provided in outer shroud member 12 and which are angularly spaced about centerline 16. Bores 36 penetrate or intersect shroud endwall 24 and extend into a plurality of cylindrical extensions or bosses 48, which project radially outward from shroud member 12. Outboard stem portions 32 extend fully through bores 36 and bosses 48 for connection to an annular array of drive arms 40. The opposing ends of drive arms 40 are rotatably joined to a drive ring assembly 42. During operation of variable vane device 10, a non-illustrated actuator rotates drive ring assembly 42 to swivel drive arms 40 about their respective rotational axes or pivot points. Rotation of drive ring assembly 42 turns rotationally-driven translating vane structures 28 about their respective rotational axes in a synchronized manner. Adjustments in the angular positioning of translating vane structures 28 may be implemented in accordance with a predetermined schedule, as a function of core engine speeds, or as a function of another operational parameter of the GTE. To facilitate rotation of translating vane structures 28, a number of flanged tubular bushings or sleeves 44 may be received within bores 36 and positioned around outboard stem portions 32. Although hidden from view in FIG. 1, similar bushing or sleeves may likewise be around within bores 38 and around inboard stem portions 34 of translating vane structures 28. One such sleeve shown in FIG. 3 and identified by reference numeral "46."

Figure 2:
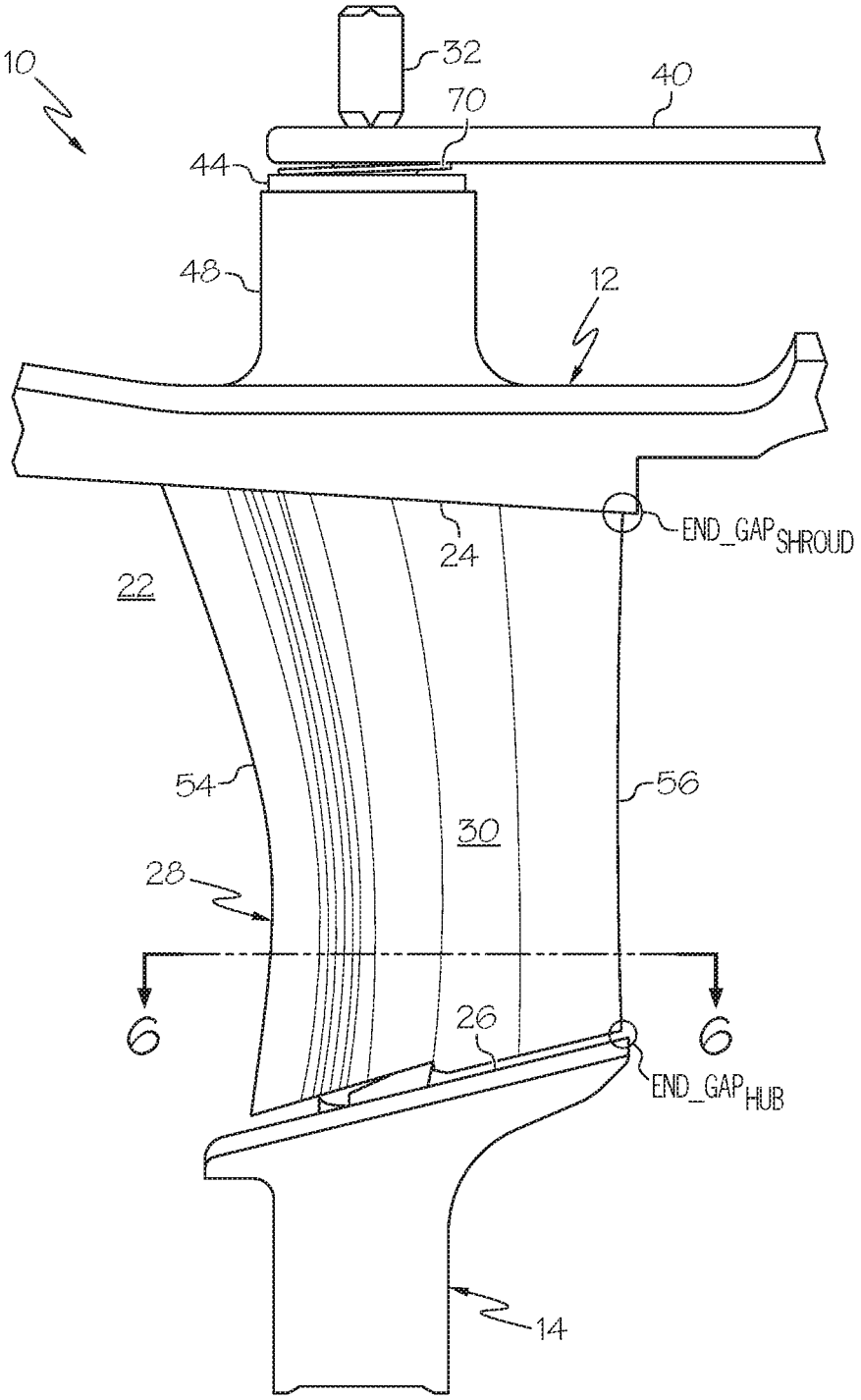
FIGS. 2 and 3 are side cutaway and exploded views, respectively, illustrating a portion of the variable vane device shown in FIG. 1 including a single rotationally-driven translating vane structure, a mating pair of ramped spacers, and a resilient preload member urging contact between the ramped spacers.
Figure 3:
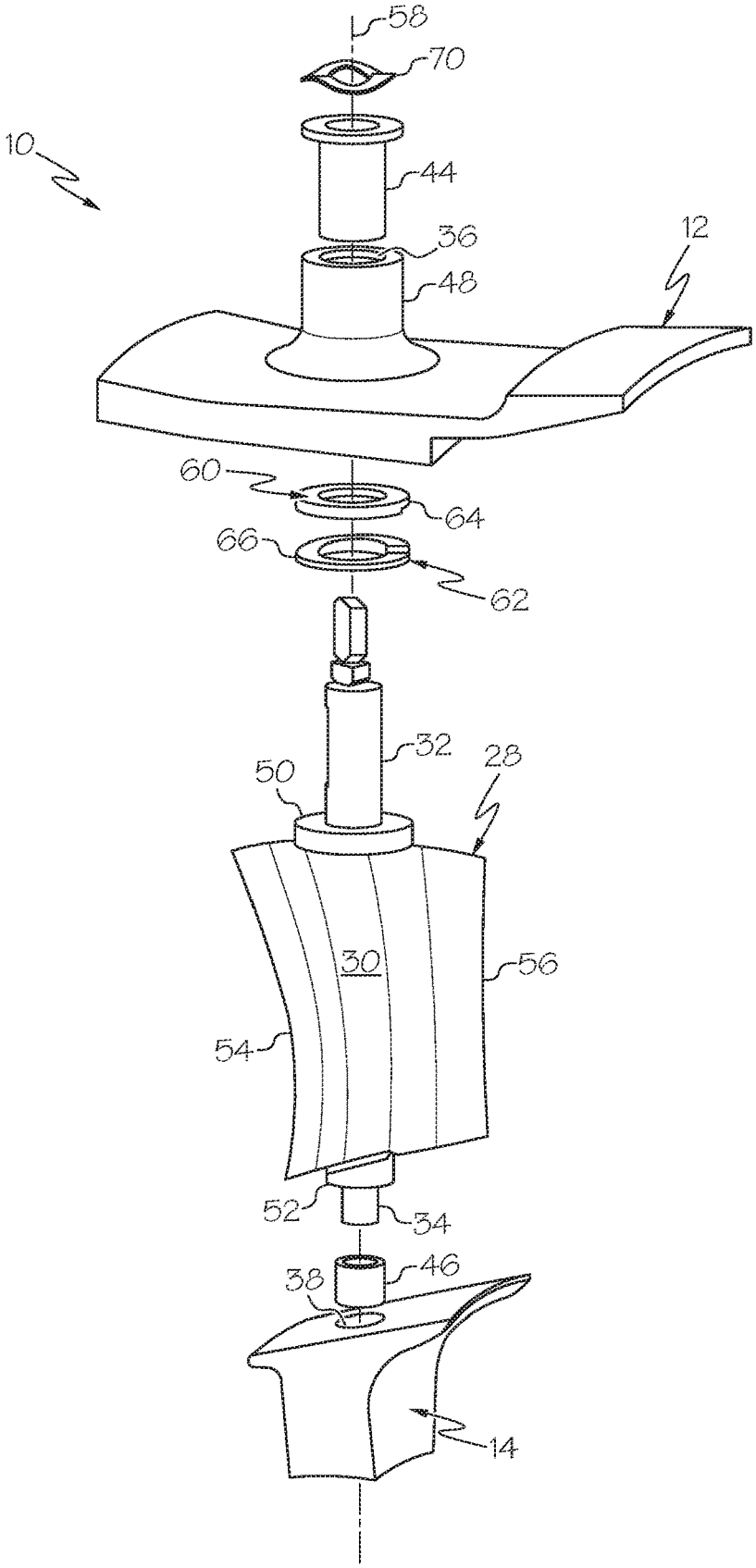

FIGS. 2 and 3 are side cutaway and exploded views, respectively, depicting a selected portion of variable vane device 10 in greater detail. While only a limited portion of device 10 is shown in FIGS. 2-3, the illustrated portion of variable vane device 10 is generally representative of the other non-illustrated portions of device 10, again noting that device 10 is generally axisymmetric about centerline 16. In addition to the previously-described features, rotationally-driven translating vane structure 28 further includes an upper cylindrical feature or "outboard button portion 50," as well as a lower cylindrical feature or "inboard button portion 52." Outboard button portion 50 is located between vane body 30 and outboard stem portion 32, while inboard button portion 52 is located between vane body 30 and inboard stem portion 34. Thus, generally stated, vane body 30 is positioned between stem portions 32, 34, and between button portions 50, 52, as taken along the rotational and translational axis of translating vane structure 28 (represented in FIG. 3 by dashed line 58). Vane body 30 further includes a leading edge 54 and an opposing trailing edge 56, with gas flow generally conducted from left to right in the orientation shown in FIGS. 2-3.

Rotationally-driven translating vane structure 28 further contains first and second spacers 60, 62. When variable vane device 10 is assembled, spacers 60, 62 are received within bore 36 provided in outer shroud member 12. Spacers 60, 62 are thus hidden from view in FIGS. 1 and 2, but can be seen in the exploded view of FIG. 3. Spacers 60, 62 each have a substantially annular or washer-shaped geometry and extend around outboard stem portion 32 of translating vane structure 28. Spacer 60 includes a ramped surface 64, while spacer 60 includes a similar or identical ramped surface 66. Ramped surface 64 of spacer 60 matingly engages or seats against ramped surface 66 of spacer 62 when spacers 60, 62 are properly positioned within bore 36. Additionally, the opposing, non-ramped surface of spacer 60 contacts or seats against an interior surface of outer shroud member 12, while the non-ramped surface of spacer 62 seats on button portion 50 of translating vane structure 28. Spacer 60 engages outer shroud member 12 in a rotationally-fixed relationship, while spacer 62 engages translating vane structure 28 in rotationally-fixed relationship. Spacers 60, 62 can be permanently or removably joined to outer shroud member 12 and translating vane structure 28 in various different manners providing the desired rotationally-fixed couplings, as described more fully below in conjunction with FIG. 4.

The illustrated portion of variable vane device 10 shown in FIGS. 2-3 further includes at least one resilient preload member 70, which helps maintain contact between ramped surfaces 64, 66 and deters undesired vibrational or loose movement of translating vane structure 28 along rotational/translational axis 58 (FIG. 3). In the illustrated example, resilient preload member 70 is compressed between drive arm 40 and a flanged end of sleeve 44 and, thus, exerts a pulling force on outboard stem portion 32 through drive arm 40 to urge contact between ramped surfaces 64, 66. As indicated in FIG. 3, resilient preload member 70 may be a compression spring and, specifically, a wave or spring washer. In further embodiments, resilient preload member 70 may assume another form, such as that of a wave spring, a coil spring, a machined spring, a belleville washer stack, or an elastomeric member. Collectively, ramped surfaces 64, 66 and resilient preload member 70 form a cam mechanism 64, 66, 70, which adjusts the translational position of vane body 30 relative to static flow assembly 12, 14 in conjunction with rotation of translating vane structure 28, as described more fully below.

Relative rotation between spacers 60, 62 occurs in conjunction with rotation of rotationally-driven translating vane structure 28 relative to outer shroud member 12 and, more generally, relative to static flow structure 12, 14. As relative rotation occurs between spacers 60, 62, ramped surface 66 slides along ramped surface 64 to adjust the axial height of spacer pair 60, 62. Stated differently, the width of the gap or gaps that separate the regions of surfaces 64, 66 that rotate out of contact increases in conjunction with relative rotation of spacers 60 62. As the axial height across spacer pairs 60, 62 increases, spacer pair 60, 62 urges translating vane structure 28 to slide radially inward (downward in FIGS. 2-3). This linear motion of rotationally-driven translating vane structure 28 further compresses resilient preload member 70 between control arm 40 and flanged sleeve 44, and results in a corresponding adjustment to the radial or translational position of vane body 30 within annular flow passage 20 (FIG. 1). The translational movement of vane body 30 thus further results in a corresponding dynamic adjustments to the clearances provided between: (i) the outboard edge of vane body 30 and shroud endwall 24 (hereafter, the "shroud endwall clearance"), and (ii) the inboard edge of vane body 30 and hub endwall 26 (hereafter, the "hub endwall clearance").

The geometry (e.g., pitch, dimensions, periodicity, etc.) of ramped surfaces 64, 66 can be adjusted, by design, to translate vane body 30 through any desired range of linear positions in conjunction with rotation of translating vane structure 28. In the illustrated example, a single ramped surface 64, 66 is provided on each of spacers 60, 62 and extends fully around rotational/translational axis 58 (FIG. 3). In further embodiments, spacers 60, 62 may each include multiple ramped surfaces, which are angularly spaced or staggered about axis 58 such that the spacers 60, 62 may engage along multiple sliding interfaces or multiple points-of-contact. Spacers 60, 62 can be fabricated from various different materials including polymeric materials, such as thermoplastic polymers when variable vane device 10 is utilized within lower temperature applications (e.g., as part of an IGV system); and including metallic materials when variable vane device 10 is utilized within higher temperature applications (e.g., as variable vane stage contained in the compressor or turbine section of a GTE). Ramped surfaces 64, 66 may be coated with a low friction material, if desired.

In the embodiment shown in FIGS. 2-3, rotational axis 58 (FIG. 3) of translating vane structure 28 is located closer to leading edge 54 than to trailing edge 56 of vane body 30. Consequently, and depending upon endwall geometry, variations in the shroud and hub endwall clearances may be most prominent adjacent the outboard corner of trailing edge 56 and adjacent the inboard corner of trailing edge 56, which are respectively identified as "$END_GAP_{SHROUD}$" and "$END_GAP_{HUB}$" in FIG. 2. For this reason, the following description primarily focuses on the shroud and hub endwall clearances at these locations. This notwithstanding, embodiments of variable vane device 10 can be tailored to adjust the gap width of the shroud and hub endwall clearances adjacent any targeted portion or portions of the vane bodies. For example, in an embodiment in which rotational axis 58 (FIG. 3) is located closer to trailing edge 56 than to leading edge 54, the variance in shroud and hub endwall clearances across the vane angular ROM may be more pronounced adjacent the leading edges of the vane body, which also may be subject to greater aerodynamic loading. In such embodiments, the translational movement of translating vane structure 28 can be tailored to principally control the shroud endwall clearance and/or hub endwall clearance at this location.

Figure 4:
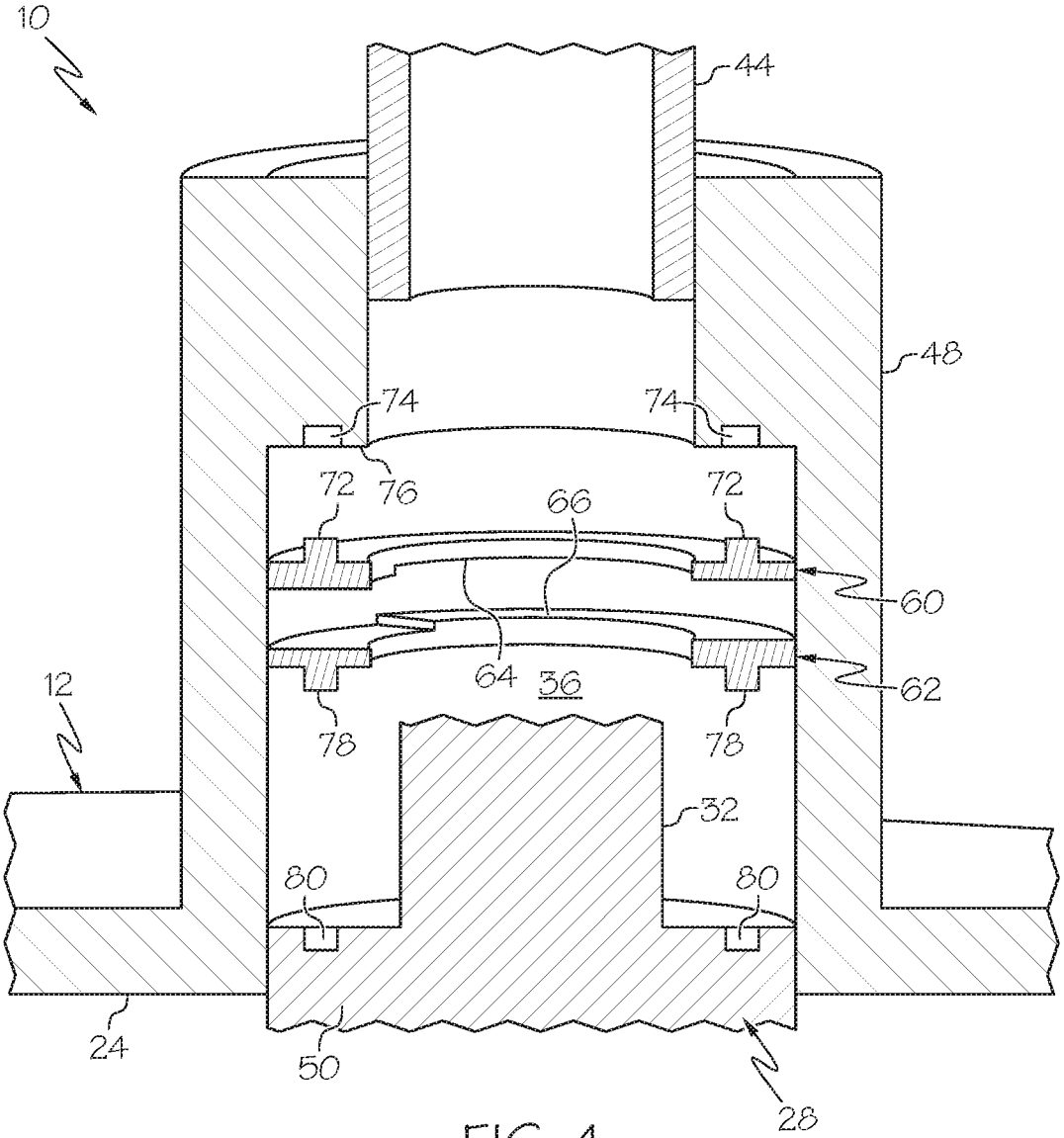
FIG. 4 is a cross-sectional view of the variable vane device shown in FIGS. 1-3 taken through the shroud member and more clearly illustrating one manner in which the first and second ramped spacers may respectively engage the annular flow assembly and the translating vane structure in a rotationally-fixed relationship.

FIG. 4 is a cross-sectional view of variable vane device 10 shown in FIGS. 2-3, as taken along section plane extending through boss 48 of outer shroud member 12. In this view, it can be seen that spacer 60 is fabricated to include a number of anti-rotation posts or pins 72, which project axially from spacer 60 in a direction opposite ramped surface 64. Anti-rotation pins 72 are matingly received by a corresponding number of openings 74 provided in an inner circumferential shelf ledge or portion 76 of boss 48 to rotationally affix spacer 60 to outer shroud member 12. Spacer 62 is similarly produced to include a number of anti-rotation pins 78, which are matingly received in openings 80 provided in outboard button portion 50 of translating vane structure 28. Spacer 62 thus rotates in conjunction with rotationally-driven translating vane structure 28 as translating vane structure 28 rotates relative to outer shroud member 12 and, more generally, relative to static flow assembly 12, 14. In contrast, rotation of spacer 60 is prevented by the rotationally-fixed coupling to flow assembly 12, 14. In further embodiments, spacers 60, 62 can be rotationally fixed to shroud member 12 and translating vane structure 28, respectively, in a different manner. For example, and depending upon the material from which spacer 60 is fabricated, spacer 60 may be adhesively joined, welded, or otherwise permanently bonded to the interior surfaces of bore 36 in further embodiments. So too may spacer 62 be permanently bonded to outboard button portion 50 of translating vane structure 28.

Figure 5:
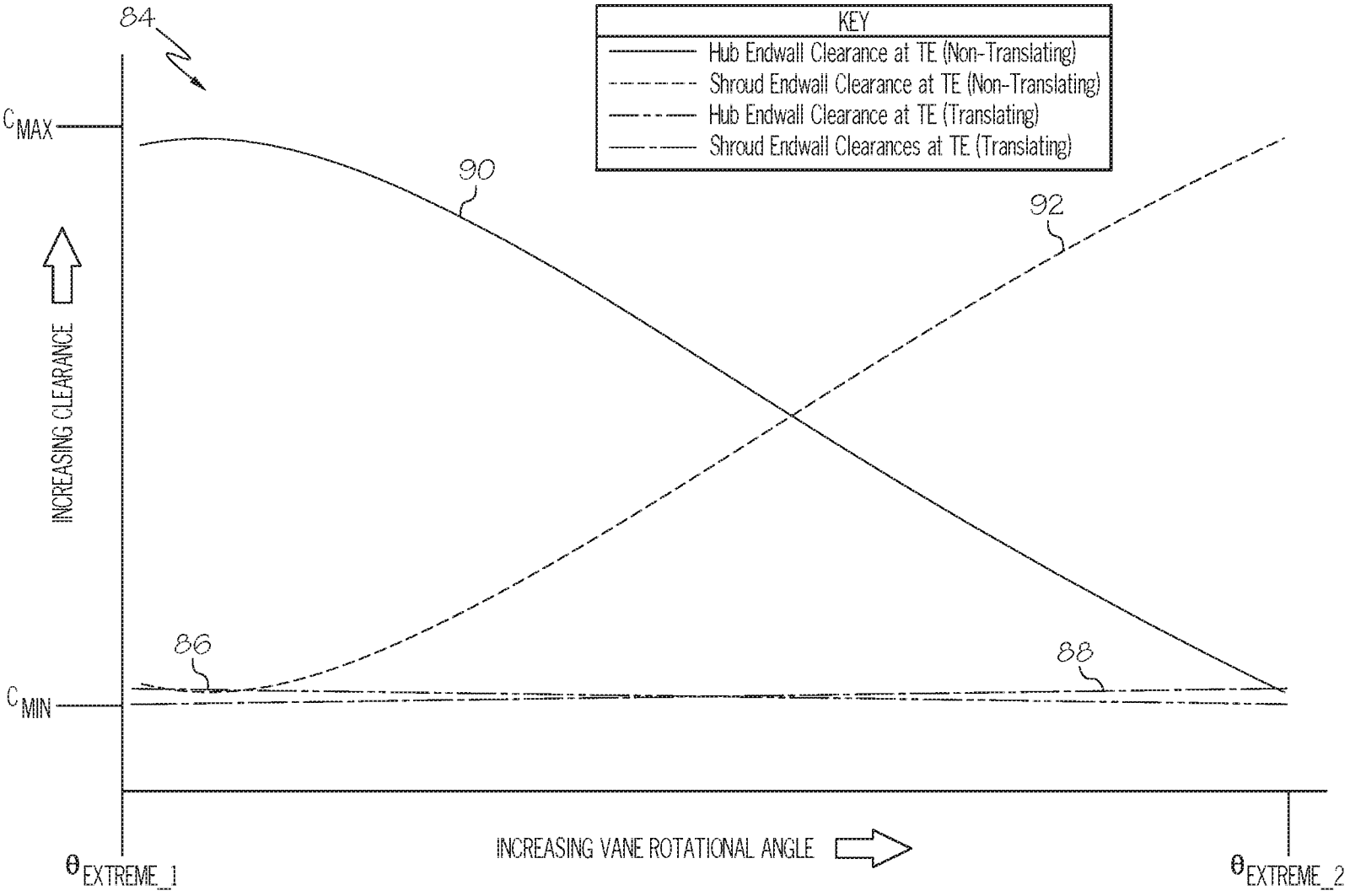
FIG. 5 is a graph of vane rotational angle (abscissa) versus radial clearance (ordinate) for the rotationally-driven translating vane structure shown in FIGS. 2-4 (and generally representative of a subset or all of the translating vane structures shown in FIG. 1) in an embodiment as compared to conventional variable vane device lacking translating vane structures.
Figure 6:
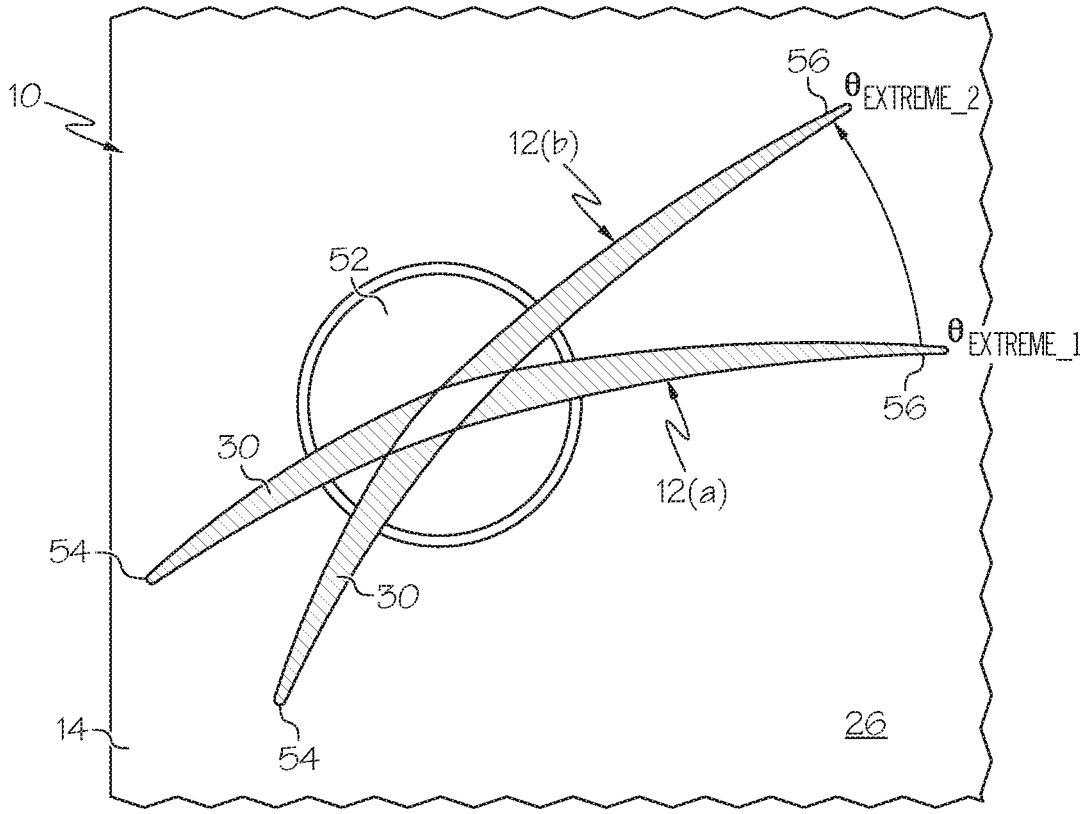
FIG. 6 is a cross-sectional view of the portion of the variable vane device shown in FIG. 2, as taken along section plane 6-6 (identified in FIG. 2) and illustrating an exemplary angular Range of Motion (ROM) through which the rotationally-driven translating vane structure may rotate in an embodiment.

Turning now to FIG. 5, there is shown a graph 84 plotting vane rotational angle (abscissa) versus endwall clearances (ordinate), as taken adjacent trailing edge 56 of vane body 30 over the angular ROM of rotationally-driven translating vane structure 28. Graph 84 includes: (i) a first characteristic or trace 86, which denotes the hub endwall clearance adjacent trailing edge 56 (corresponding to $END_GAP_{HUB}$ in FIG. 2) as translating vane structure 28 rotates from a first rotational extreme ($\theta_{EXTREME_1}$) to a second, opposing rotational extreme ($\theta_{EXTREME_2}$); and (ii) a second characteristic or trace 88, which denotes the shroud endwall clearance adjacent trailing edge 56 (corresponding to $END_GAP_{SHROUD}$ in FIG. 2) as translating vane structure 28 rotates from $\theta_{EXTREME_1}$ to $\theta_{EXTREME_2}$. The angular ROM of rotationally-driven translating vane structure 28 (that is, the difference between $\theta_{EXTREME_1}$ and $\theta_{EXTREME_2}$) will vary amongst implementations of variable vane device 10; however, by way of example, the angular ROM of translating vane structure 28 may range from about 30 degrees (°) to about 90° in an embodiment. For visual correlation, the rotation of translating vane structure 28 between $\theta_{EXTREME_1}$ and $\theta_{EXTREME_2}$ is further illustrated in FIG. 6, which is a cross-sectional view of variable vane device 10 taken along plane 6-6 identified in FIG. 2.

As further plotted in graph 84 (FIG. 5), traces 90, 92 represent the hub and shroud endwall clearances, respectively, for a comparison device that is similar to variable vane device 10 (FIGS. 1-4), but which lacks translating vane structures. As graphically indicated by traces 90, 92, the hub and shroud endwall clearances of the comparison variable vane device vary significantly as the vane structures rotate from $\theta_{EXTREME_1}$ to $\theta_{EXTREME_2}$. Specifically, in this particular example, the hub endwall clearance of the comparison device (trace 90) gradually decreases from a maximum value ($C_{MAX}$) to a minimum value ($C_{MIN}$) as a given vane structure rotates through its angular ROM. Concurrently, the shroud endwall clearance of the comparison device (trace 92) gradually increases from the minimum value ($C_{MIN}$) to the maximum value ($C_{MAX}$) in a substantially inverse relationship with the hub endwall clearance (trace 90). The radial gap width of the hub endwall clearance (trace 90) at the first rotational extreme ($\theta_{EXTREME_1}$) is thus quite large (e.g., several times $C_{MIN}$), as is the radial gap width of the shroud endwall clearance at the second rotational extreme ($\theta_{EXTREME_2}$). Significant end gap leakage may consequently occur at the first and second rotational extremes, as well as the rotational positions between $\theta_{EXTREME_1}$ and $\theta_{EXTREME_2}$. Furthermore, a decrease in the clearance width generally cannot be achieved by moving any portion of traces 90, 92 below $C_{MIN}$, which represents a minimum threshold value below which undesired physically-restrictive contact (e.g., rubbing or binding) of the vane body edges and endwall surfaces can occur considering manufacturing tolerances and the expected operational parameters (e.g., thermal growth differentials, vibrational loads, aerodynamic loads, etc.) of the comparison device.

In the embodiment shown in FIG. 5, variable vane device 10 is designed (through appropriate dimensioning of ramped surfaces 64, 66) such that the average clearance value (that is, the radial gap width taken over the angular ROM of translating vane structure 28) is improved at both the hub and shroud endwalls. In this regard, and as indicated by graph 84, variable vane device 10 (FIGS. 1-4) achieves a significant reduction in the average clearance width at the hub endwall (trace 86) and the shroud endwall (trace 88) across the angular ROM of translating vane structure 28. The reduction in clearance width is greatest at the hub endwall and shroud endwall when translating vane structure 28 resides in $\theta_{EXTREME_1}$ and in $\theta_{EXTREME_2}$, respectively. The translational movement imparted to translating vane structure 28 by cam mechanisms 60, 62, 70 is thus leveraged to provide improvements in clearance width at one or more locations adjacent vane body 30 to reduce end gap leakage and/or to otherwise enhance the performance of variable vane device 10. In this regard, variable vane device 10 may be designed such that the hub endwall clearance (trace 86) and/or the hub endwall clearance, as averaged over the angular ROM of translating vane body 30, is substantially equivalent to or slightly greater than the minimum threshold value set by $C_{MIN}$. End gap leakage may be significantly reduced as a result.

In certain embodiments, variable vane device 10 may be further designed such that the hub endwall clearance (trace 86) and the shroud endwall clearance (trace 88) are maintained at substantially constant values across the angular ROM of translating vane structure 28, whether measured adjacent trailing edge 56 or leading edge 54 of vane body 30; the term "substantially constant," as appearing herein, indicating that the maximum value of a given radial clearance or gap width is less than twice the minimum value of the radial clearance, as taken across the angular ROM of the translating vane structure. Additionally, in embodiments, the difference between the maximum and minimum values of the clearance width for the hub endwall clearance (trace 86) and/or for the shroud endwall clearance (trace 88) may be less than 2% the chord length of vane body 30 (FIGS. 1-3). In still further embodiments, variable vane device 10 may be designed such that an improvement in clearance width (whether considered as an average over the vane angular ROM or at a particular angular position of vane structure 28) is achieved only at the hub endwall clearance (trace 86) or the shroud endwall clearance (trace 88). However, even in this case, variable vane device 10 can be configured to adjust the translational positions of vane bodies 30 (FIGS. 1-4) within annular flow passage 20 (FIG. 1) such that an average value of the radial clearances over the angular ROM of translating vane structures 28 is favorably decreased by virtue of the translational movement imparted to the rotationally-driven translating vane structures by cam mechanisms 60, 62, 70.

There has thus been provided an exemplary embodiment of a variable vane device containing rotationally-driven translating vane structures and a number of cam mechanisms, which adjust the translational position of the vane bodies in conjunction with rotational movement of the translating vane structures. In the above-described example, each cam mechanism contains a pair of ramped surfaces between which relative rotation occurs in conjunction with vane structure rotation. The physical characteristics of ramped surfaces 64, 66 (e.g., slope, amplitude, and phase) can be tailored, as desired, to control the rate, amount, and timing respectively of the clearances through the angular ROM of the rotationally-driven translating vane structures. While the ramped surfaces were provided on discrete pieces (e.g., ramped spacers) in the foregoing exemplary embodiment, this need not be the case in all embodiments. Instead, in further embodiments, the ramped surfaces can be provided on other surfaces of the variable vane device and, perhaps, integrally formed with the static flow assembly and/or the rotationally-driven translating vane structures. A further exemplary embodiment of the variable vane device will now be described in conjunction with FIG. 7 to further emphasize this point.

Figure 7:
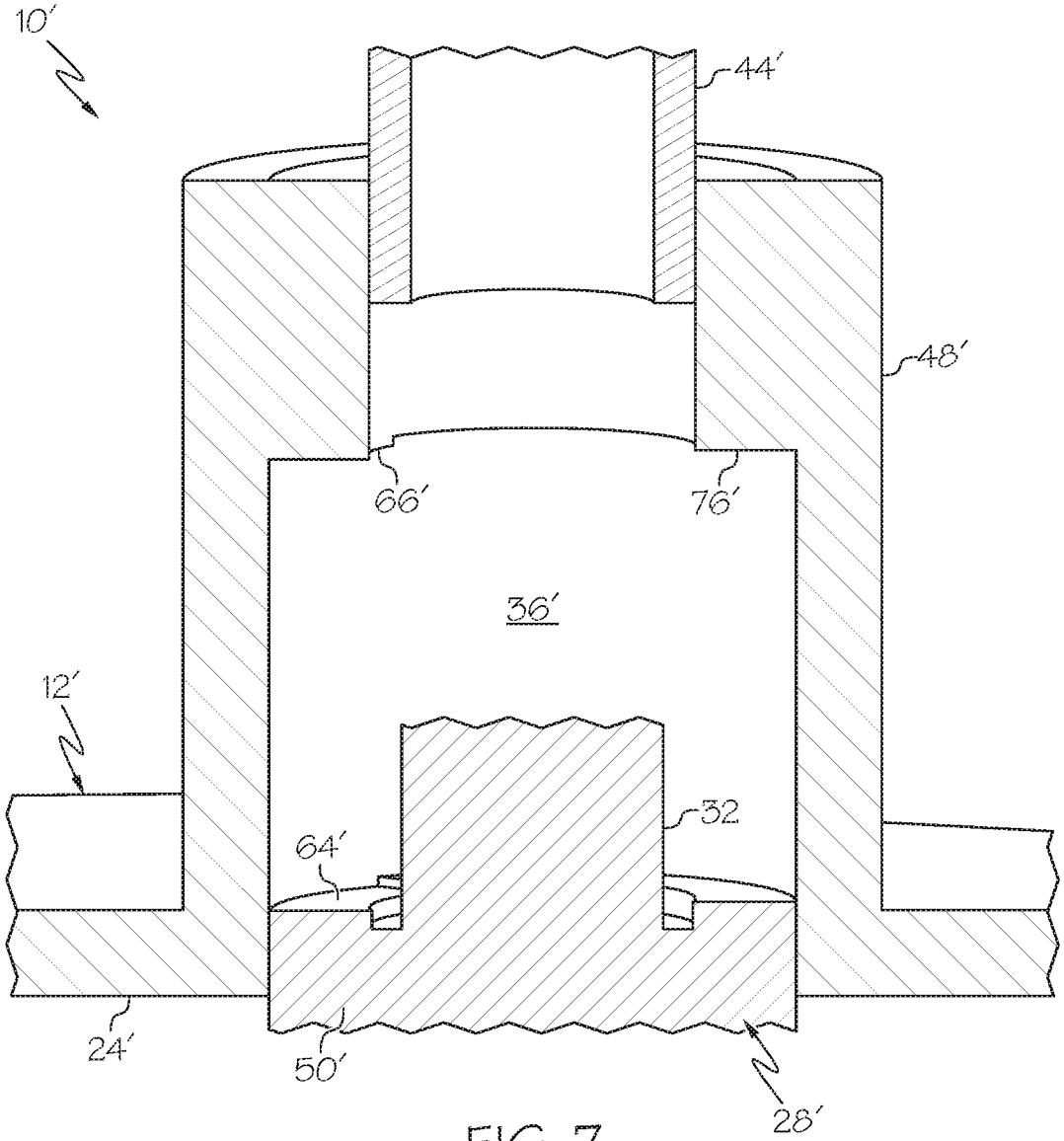
FIG. 7 is a detailed cross-sectional view of a variable vane device containing mating ramped surfaces, which are machined into or otherwise integrally formed with surfaces of the annular flow assembly (e.g., within a bore of the shroud member) and the rotationally-driven translating vane structure, as illustrated in accordance with a further exemplary embodiment of the present disclosure.

FIG. 7 is a cross-sectional view of a variable vane device 10', which is similar to variable vane device 10 shown in FIGS. 1-5. For consistency, like components of variable vane device 10' are identified utilizing the previously-introduced reference numerals, but with the addition of a prime symbol (') to indicate that such features may differ to varying extents. As does variable vane device 10 shown FIGS. 1-5, variable vane device 10' includes an outer shroud member 12', an outboard sleeve 44', a rotationally-driven translating vane structure 28' (partially shown), and a mating pair of ramped surfaces 64', 66'. Again, ramped surfaces 64', 66' are located within bore 36' when device 10' is fully assembled. However, in this particular example, ramped surface 64' is integrally formed in outer hub member 12; e.g., ramped surface 64' may be machined into or otherwise integrally formed in inner circumferential shelf 76' of boss 48'. Conversely, ramped surface 66' is integrally formed with button portion 50' of translating vane structure 28'. When variable vane device 10' is assembled, ramped surfaces 64', 66' are placed in engagement. As translating vane structure 28' rotates relative to outer shroud member 12', so too does ramped surface 64' rotate relative to ramped surface 66'. The axial spacing between surfaces 64', 66' thus varies in conjunction with rotation of translating vane structure 28' to adjust the radial or translational position of the non-illustrated vane body of translating vane structure 28'. Through the inclusion of translating vane structure 28' (and similar non-illustrated translating vane structures included within variable vane device 10'), embodiments of variable vane device 10' may reduce endwall clearances over the angular ROM of translating vane structure 28 to reduce end gap leakage rates and improve the overall performance of variable vane device 10' in the manner previously described.

The foregoing has thus provided multiple exemplary embodiments of a variable vane devices containing rotationally-driven translating vane structures. By virtue of the controlled translational movement of the translating vane structures, a reduction in the clearances between the vane bodies and neighboring flow assembly surfaces is achieved to reduce end gap leakage and boost device performance levels. The controlled translational movement may be imparted to the translating vane structures utilizing cam mechanism, which are further integrated into the variable vane device. In embodiments wherein the flow assembly has an annular endwall (e.g., a hub or shroud endwall) partially bounding the annular flow passage and wherein the vane bodies are separated or radially offset from the annular endwall by radial clearances, the cam mechanisms may be configured to adjust the translational positions of the vane bodies such that an average value of the radial clearances is decreased due to the translational movement imparted to the rotationally-driven translating vane structures by the cam mechanisms. In such embodiments, the radial clearances vary from a maximum value to a minimum value over an angular ROM of the translating vane structures, and wherein the cam mechanisms are configured to adjust the translational positions of the vane bodies within the annular flow passage such that the difference between the maximum and minimum values is less than 2% a chord length of the vane body.

In the above-described exemplary embodiments, the cam mechanisms each include a rotating ramped surface and a non-rotating ramped surface, which engage the rotating ramped surface along a sliding interface. In the exemplary embodiment discussed above in conjunction with FIGS. 1-6, the ramped surfaces are formed on discrete parts and, specifically, annular washers or spacers. In the exemplary embodiment described above in conjunction with FIG. 7, the ramped surfaces are instead integrally formed on or in surfaces of the static flow structure (e.g., shroud or hub member) and the translating vane structures. As a point of emphasis, the foregoing features can be combined to yield further embodiments of the variable vane device and, therefore, are not mutually excusive in the context of the present disclosure. For example, further embodiments of the variable vane device may include a first ramped surface, which is formed on an annular spacer or other discrete piece; and a second mating ramped surface, which engages the first ramped surface and which is integrally formed in the static flow structure or a translating vane structure. Ramped surfaces may also be provided inboard (rather than outboard) of the vane bodies such that the non-rotating ramped surfaces are joined to or integrally formed with the inner hub member. As a still further possibly, ramped surface pairs can be provided both inboard and outboard of the vane bodies; e.g., a first pair of ramped surfaces may be disposed outboard of each vane body in a manner similar to that described above in conjunction with FIGS. 1-5 and 7, while a second pair of complementary sloped surfaces (e.g., ramped spacers) may further be disposed inboard of each vane body.

The foregoing has further provided methods for producing a variable vane device containing rotationally-driven translating vane structures. The variable vane devices may be fabricated pursuant to original manufacture. Alternatively, the variable vane device may be produced by modifying a pre-existing variable vane device containing vane structures initially designed for rotational, but not translational movement. In the latter case, a pre-existing variable vane device lacking translating vane structures may be obtained and modified to include those features creating the desired translational movement of the vane structures. As one possibility, ramped surfaces can be machined into selected surfaces of the pre-existing variable vane device, such as the interior surfaces of the bores provided in the static flow assembly and/or into the button portions of the vane structures. Discrete members having ramped surfaces can be added to the pre-existing variable vane device by retrofit installation. For example, a first set of ramped spacers can be inserted into the bores of the static flow assembly and rotationally affixed thereto in different manners, while a second set of ramped spacers can be inserted around the stem portions of the vane structures as previously described. Similarly, resilient preload members can be installed by retrofit in various different locations as appropriate to exert a convergent preload force urging contact of mating pairs of the ramped surfaces. Material can be removed from the interior of the bores and/or other structural modifications can be made to the pre-existing variable vane device to accommodate the addition of any such ramped spacers and resilient preload members.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as setforth in the appended claims.

What is claimed is:

1. A variable vane device, comprising:

a flow assembly having a centerline and an annular endwall partially bounding the flow passage;

an annular flow passage extending through the flow assembly;

a plurality of rotationally-driven translating vane structures coupled to the flow assembly and rotatable relative thereto, each of the rotationally-driven translating vane structures having an angular Range of Motion (ROM) and including a vane body positioned within the annular flow passage and angularly spaced about the centerline, wherein edge portions of each of the the vane bodies are separated from the annular endwall by a radial clearance; and a plurality of cam mechanisms, each cam mechanism coupled to the flow assembly and to a different one of the rotationally-driven translating vane structures, each cam mechanism adjusting a translational position, within the annular flow passage, of the vane body of the rotationally-driven translating vane structure to which it is coupled as the rotationally-driven translating vane structure rotates relative to the flow assembly, and such that an average value of each of the radial clearances over the angular ROM is decreased due to the translational movement imparted to each of the rotationally-driven translating vane structures by each of the cam mechanisms.

2. The variable vane device of claim 1 wherein each of the cam mechanisms comprise rotating ramped surfaces, which are coupled to and which rotate in conjunction with the rotationally-driven translating vane structures.

3. The variable vane device of claim 2 wherein each of the cam mechanisms further comprise non-rotating ramped surfaces, which are coupled to the flow assembly in a rotationally-fixed relationship and which engage the rotating ramped surfaces.

4. The variable vane device of claim 3 wherein the rotating ramped surfaces slide along the non-rotating ramped surfaces as the rotationally-driven translating vane structures rotate relative to the flow assembly to adjust the translational positions of the vane bodies within the annular flow passage.

5. The variable vane device of claim 3 wherein each of the cam mechanisms further comprise resilient preload members urging contact between the non-rotating and rotating ramped surfaces.

6. The variable vane device of claim 2 wherein the rotating ramped surfaces are integrally formed with the rotationally-driven translating vane structures.

7. The variable vane device of claim 6 wherein each of the rotationally-driven translating vane structures comprise:

stem portions;

vane bodies; and button portions between the stem portions and the vane bodies, the rotating ramped surfaces integrally formed in the button portions of the rotationally-driven translating vane structures opposite the vane bodies.

8. The variable vane device of claim 2 further comprising a plurality of spacers, each spacer rotationally affixed to a different one of the rotationally-driven translating vane structures, the rotating ramped surfaces formed on the plurality of spacers.

9. The variable vane device of claim 8 wherein the flow assembly comprises a plurality of bores provided in a circumferential surface of the flow assembly and angularly spaced about the centerline, wherein each of the rotationally-driven translating vane structures extend into a different one of the plurality of bores, and wherein the plurality of spacers is matingly received in the plurality of bores.

10. The variable vane device of claim 1 wherein the radial clearances vary from a maximum value to a minimum value over the angular ROM, and wherein each of the cam mechanisms are configured to adjust the translational positions of the vane bodies within the annular flow passage such that the difference between the maximum and minimum values is less than 2% a chord length of the vane body.

* * * * *